US010799942B2

(12) United States Patent
Fukunaga et al.

(10) Patent No.: US 10,799,942 B2
(45) Date of Patent: Oct. 13, 2020

(54) IMMERSION NOZZLE

(71) Applicant: KROSAKIHARIMA CORPORATION, Fukuoka (JP)

(72) Inventors: Shinichi Fukunaga, Fukuoka (JP); Arito Mizobe, Fukuoka (JP); Kenichi Oki, Fukuoka (JP); Hiroki Furukawa, Fukuoka (JP)

(73) Assignee: KROSAKIHARIMA CORPORATION, Fukuoka (JP)

( * ) Notice: Subject to any disclaimer, the term of this patent is extended or adjusted under 35 U.S.C. 154(b) by 311 days.

(21) Appl. No.: 15/774,319

(22) PCT Filed: Sep. 13, 2016

(86) PCT No.: PCT/JP2016/076915
§ 371 (c)(1),
(2) Date: May 8, 2018

(87) PCT Pub. No.: WO2017/081934
PCT Pub. Date: May 18, 2017

(65) Prior Publication Data

US 2020/0188991 A1 Jun. 18, 2020

(30) Foreign Application Priority Data

Nov. 10, 2015 (JP) ..... 2015-220580

(51) Int. Cl.
*B22D 41/08* (2006.01)
*B22D 11/06* (2006.01)
(Continued)

(52) U.S. Cl.
CPC ..... *B22D 11/0642* (2013.01); *B22D 11/103* (2013.01); *B22D 41/50* (2013.01)

(58) Field of Classification Search
CPC ..... B22D 41/50
(Continued)

(56) References Cited

U.S. PATENT DOCUMENTS 7,905,432 B2 * 3/2011 Nomura ..... B22D 41/50 164/437
2016/0082509 A1 * 3/2016 Tang ..... B22D 41/50 164/437

FOREIGN PATENT DOCUMENTS

CN 101733373 A 6/2010
CN 101966567 A 2/2011
(Continued)

OTHER PUBLICATIONS

International Search Report dated Oct. 31, 2016 for PCT/JP2016/076915 filed Sep. 13, 2016.
(Continued)

*Primary Examiner* — Scott R Kastler
(74) *Attorney, Agent, or Firm* — Paul D. Bianco; Gary S. Winer; Fleit Intellectual Property Law

(57) ABSTRACT

A flat immersion nozzle stabilizes the discharging flow of molten steel thereby stabilizing the molten steel surface in a mold, namely, decreasing the fluctuation thereof. In the immersion nozzle having a flat shape in which a width Wn of an inner hole is greater than a thickness Tn of the inner hole, a central protrusion portion (1) is disposed in a center section of a wall surface in a width direction of a flat section. Wp/Wn, a ratio of a length Wp of the central protrusion portion in the width direction to Wn, is 0.2 or more and 0.7 or less. The central protrusion portion (1) is disposed symmetrically as a pair; and a total length Tp in the thickness direction of the pair of the central protrusion portions is 0.15 or more and 0.75 or less of Tn.

9 Claims, 3 Drawing Sheets

(51) Int. Cl.
*B22D 11/103* (2006.01)
*B22D 41/50* (2006.01)

(58) Field of Classification Search
USPC ..... 164/437; 222/594, 606, 607
See application file for complete search history.

(56) References Cited

FOREIGN PATENT DOCUMENTS

| | | | |
|---|---|---|---|
| CN | 103231048 | A | 8/2013 |
| JP | 58-361 | A | 1/1983 |
| JP | 11-047897 | A | 7/1997 |
| JP | 11-005145 | A | 4/1998 |
| JP | 2004-122226 | A | 4/2004 |
| JP | 2001-501132 | A5 | 6/2005 |

OTHER PUBLICATIONS

Written Opinion for PCT/JP2016/076915 filed Sep. 13, 2016.
International Preliminary Report on Patentability dated May 15, 2018 for PCT/JP2016/076915 filed Sep. 13, 2016 (English translation).
Written Opinion dated Nov. 8, 2016 for PCT/JP2016/076915 filed Sep. 13, 2016 (English translation).

* cited by examiner

Fig. 1A
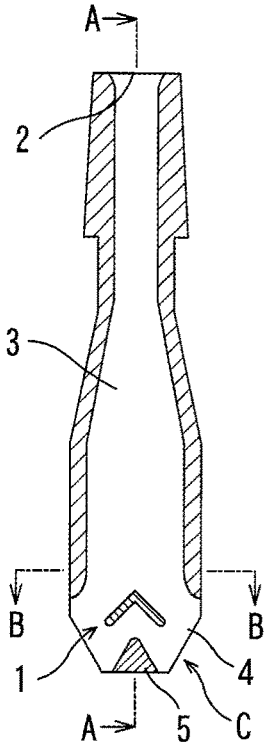
Fig. 1B
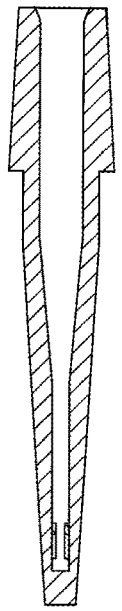
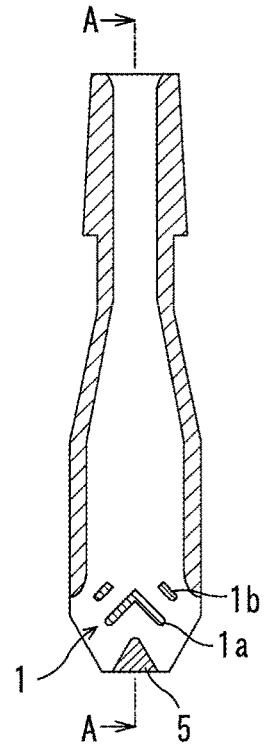
Fig. 2A
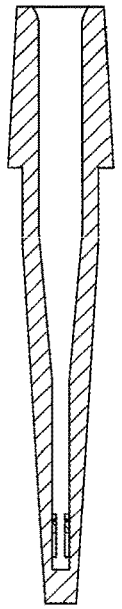
Fig. 2B

IMMERSION NOZZLE

TECHNICAL FIELD

The present invention relates to an immersion nozzle for continuous casting, through which nozzle a molten steel is poured into a mold from a tundish, especially relates to an immersion nozzle such as those used especially for a thin slab, a medium thickness slab, etc., wherein a cross section near a discharge port of the immersion nozzle in a traverse direction (direction perpendicular to the vertical direction) is of a flat shape (shape other than a true circle and a square whereby having different lengths between one side and other side).

BACKGROUND ART

In the continuous casting process by continuously solidifying a molten steel by cooling to form a cast piece having a prescribed shape, the molten steel is poured into a mold via an immersion nozzle for continuous casting that is disposed in the bottom part of the tundish (hereinafter, this nozzle is also referred to as simply "immersion nozzle").

Generally, the immersion nozzle has an upper edge part as a molten steel inlet, and is formed of a pipe body having a bottom part and a flow path (inner hole) of molten steel, wherein the flow path is formed inside the pipe body and extended downward from the molten steel inlet. In the side wall of a lower part of the pipe body, a pair of discharge ports connecting to the flow path (inner hole) of molten steel is disposed in a position opposite to each other. The immersion nozzle is used in the state that a lower part thereof is immersed into the molten steel in the mold. By so doing, not only the poured molten steel is prevented from scattering but also oxidation of the molten steel is prevented by shielding the molten steel from an air. In addition, when the immersion nozzle is used, the molten steel in the mold is rectified so as to prevent engulfment of a slag as well as impurities such as non-metallic inclusion into the molten steel, these substances being floated on surface of the molten steel.

In recent years, manufacturing of thin cast pieces such as a thin slab and a medium thickness slab during continuous casting is increasing. In order to respond to the thin mold for continuous casting like this, the immersion nozzle needs to be made flat. For example, in Patent Document 1, a flat immersion nozzle having the discharge port disposed in a side wall of a short side is described; and in Patent Document 2, a flat immersion nozzle having a discharge port further disposed in the lower edge surface is described. In these flat immersion nozzles, generally, width of the inner hole thereof is expanded from the molten steel inlet to the discharge port to the mold.

However, in the case of the immersion nozzle having a shape expanding in the width of the inner hole as well as a flat shape as mentioned above, the flow of the molten steel inside the immersion nozzle tends to be readily disturbed, thereby causing the disturbance in the discharging flow to the mold. The disturbance of the flow of the molten steel causes an increase in the fluctuation of the liquid surface (molten steel surface), an engulfment of oxide powders, as impurities and inclusions, into a cast piece, an uneven temperature distribution, etc., thereby leading to a poor quality of the cast piece, an increase in a danger during operation, and the like. Accordingly, the flow of the molten steel inside the immersion nozzle and the discharging flow thereof from the immersion nozzle need to be stabilized.

In order to stabilize these flows of the molten steel, for example, in Patent Document 3, the immersion nozzle formed with at least two bending facets extended from a point (center) of a planar surface in a lower part of the inner hole toward a lower edge of the discharge port is disclosed. In addition, in Patent Document 3, the immersion nozzle provided with a flow divider which divides the flow of the molten steel to two streams is disclosed. In the flat immersion nozzle disclosed in Patent Document 3, the flow stability of the molten steel inside the immersion nozzle is higher as compared with the immersion nozzle not provided with the means to change the flow direction or the flow modality as disclosed in Patent Document 1 and Patent Document 2 in an internal space thereof.

However, in the case of the means to divide the flow of the molten steel into left and right directions as mentioned above, the fluctuation of the discharging flow of the molten steel between the left and right discharge ports is still large, so that it can cause a large fluctuation of the molten steel surface in the mold.

CITATION LIST

[Patent Document]

Patent Document 1: Japanese Patent Laid-Open Publication No. H11-5145

Patent Document 2: Japanese Patent Laid-Open Publication No. H11-47897

Patent Document 3: Japanese Patent Application Publication No. 2001-501132

SUMMARY OF THE INVENTION

Problem to be Solved by the Invention

The problem to be solved by the present invention is to provide an immersion nozzle which can stabilize in a flat immersion nozzle the discharging flow of the molten steel so as to stabilize the molten steel surface in a mold, namely to reduce the fluctuation thereof. Consequently, an object of the present invention is to improve a quality of a cast piece.

Means for Solving the Problem

The present invention relates to a flat immersion nozzle according to the following 1 to 7 aspects.

1. An immersion nozzle, wherein the immersion nozzle has a flat shape in which a width Wn of an inner hole is greater than a thickness Tn of the inner hole, the immersion nozzle comprising: a protruding portion in a center section of a wall surface in a width direction of a flat section (hereinafter, this protruding portion is referred to as "central protrusion portion"); Wp/Wn, which is a ratio of a length Wp of the central protrusion portion in the width direction to Wn, is 0.2 or more and 0.7 or less; the central protrusion portion is disposed symmetrically as a pair; and a total length Tp of the pair of the central protrusion portions in the thickness direction is 0.15 or more and 0.75 or less of Tn (claim 1).
2. The immersion nozzle according to 1, wherein the central protrusion portion slants downward to a discharge port direction from a center in the width direction, in which the said center serves as a peak (claim 2).
3. The immersion nozzle according to 1 or 2, wherein an upper surface of the central protrusion portion slants to the thickness direction as well as a downward direction, in which a boundary portion thereof with an immersion nozzle wall in the width direction serves as a peak (claim 3).

4. The immersion nozzle according to any one of 1 to 3, wherein a protrusion length of the upper surface of the central protrusion portion is the largest in a center part of Wp and gradually decreases in directions to both edge parts from the center part (claim 4).

5. The immersion nozzle according to any one of 1 to 4, wherein the immersion nozzle comprises one or plural protrusion portions above the central protrusion portion (hereinafter, this protrusion portion is referred to as "upper protrusion portion") (claim 5).

6. The immersion nozzle according to 5, wherein the upper protrusion portion slants to a discharge port direction (claim 6).

7. The immersion nozzle according to any one of 1 to 6, wherein Wn/Tn, which is a ratio of the width to the thickness, is 5 or more (claim 7).

Meanwhile, in the present invention, the width Wn and the thickness Tn of the inner hole mean the width (length in a long side direction) and thickness (length in a short side direction), respectively, of the inner hole in the upper edge position of a pair of the discharge ports which are disposed in the side wall section of the immersion nozzle in the short side.

Advantageous Effects of Invention

Owing to the flat immersion nozzle of the present invention, flow direction of the molten steel can be continuously controlled without separating the flow of the molten steel completely or in a fixed way; and thus, a suitable balance of the flow of the molten steel inside the nozzle can be secured. With this, the discharging flow of the molten steel can be stabilized, so that the fluctuation of the molten steel surface in the mold can be reduced; and thus, the molten steel flow in a mold can be stabilized. Consequently, a quality of a cast piece can be improved.

BRIEF DESCRIPTION OF THE DRAWINGS

FIGS. 1A and 1B are conceptual figures illustrating an example of the immersion nozzle of the present invention provided with the central protrusion portion; FIG. 1A is a cross section view passing through a center of the short side; and FIG. 1B is a cross section view (view A-A) passing through a center of the long side.

FIGS. 2A and 2B are conceptual figures illustrating an example of the immersion nozzle of the present invention provided with, in addition to the central protrusion portion, the upper protrusion portion; FIG. 2A is a cross section view passing through a center of the short side; and FIG. 2B is a cross section view (view A-A) passing through a center of the long side.

DESCRIPTION OF THE EMBODIMENTS

Figure 3:
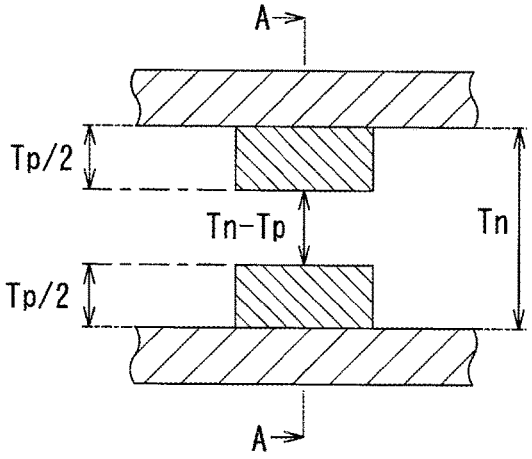
FIG. 3 is a conceptual figure viewing downward from the B-B cross section of the upper part of the central protrusion portion of FIG. 1.
Figure 4:
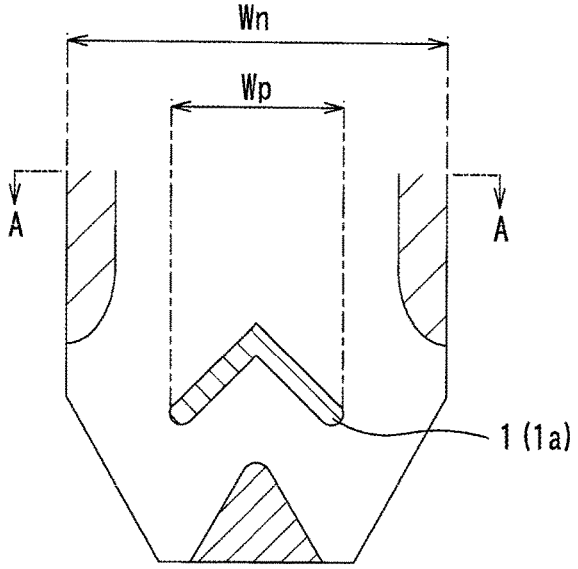
FIG. 4 is a conceptual figure illustrating an example of the C section of FIG. 1 (lower part of the immersion nozzle) wherein the central protrusion portion slants to the discharge port direction.

Flow of the molten steel dropping from the molten steel inlet, which is a narrow port located in the upper center edge of the immersion nozzle, is prone to concentrate in the center thereof. Especially in the case that there is no obstacle in the inner hole, the flow rates of the molten steel are prone to be significantly different between around the center part and around the edge part in the width direction of the flat section of the immersion nozzle.

Inventors of the present invention found that the disturbance of the flow of the molten steel discharged from the immersion nozzle, which is flat in its shape as mentioned above, is caused largely by this concentration of the molten steel flow into the center part of the inner hole thereof. Therefore, according to the present invention, the flow mount of the molten steel into the center part of the inner hole is reduced so as to have a suitable balance with the flow amount to the discharge port direction.

Disposition of the means to divide the flow as described in the cited reference 3 can generate the molten steel flow toward the edge part side in the width direction to a certain degree. However, when the flow is divided completely or in a fixed way as mentioned above, separated flows of the molten steel are generated in each part of the inner hole, i.e., in each of individual narrow regions, so that parts that the flow direction and flow rate are different in each part of the inner hole are prone to be generated. Especially when the flow rate and direction are changed by the control or like of the flow rate of molten steel, the molten steel flow is one-sided, thereby causing a very large disturbance in the flow inside the nozzle or in the discharging flow.

In the present invention, a means to gently control the flow direction and flow rate in the section where the molten steel flow passes through is disposed so as not to divide the molten steel flow in the inner hole completely or in a fixed way. Namely, the protrusion portion, which is protruded toward the inner hole space side from the inner hole wall and is nevertheless in the state of keeping a liberated part of the inner hole space in the protrusion portion, is disposed. Owing to this protrusion portion as well as by adjusting the place, length, direction, and the like of the protrusion portion, concentration of the molten steel flow to around the center part is avoided, and at the same time the molten steel flow is dispersed toward the edge part side in the width direction, namely, to the discharge port side, so that a suitable balance can be obtained. In addition, because not only the molten steel flow is dispersed but also the space is communicated in the region where the protrusion portion is disposed, the molten steel flow is not in the state of being completely divided, so that the molten steel is gently mixed thereby becoming a dispersed flow while being equalized. As a result of this, the discharging region is not divided into narrow regions to generate the parts with different directions and flow rates, thereby contributing to obtain the equalized discharging flow. The protrusion portion having the function like this is disposed firstly in the center part of the wall surface in the width direction (long side) of the flat section of the immersion nozzle (central protrusion portion).

Also, the upper surface of the central protrusion portion may be slanted to the width direction of the immersion nozzle as well as the downward direction, namely, to the direction of the discharge port, in which the center part of the long side of the protrusion portion serves as a peak. With the slope like this, the flow rate and flow modality of the molten steel can be further changed so as to be optimized.

Also, the upper surface of the central protrusion portion may be slanted to the center direction of the thickness direction of the immersion nozzle, namely, to the space side, as well as the downward direction, in which the boundary portion with the wall surface in the width direction of the immersion nozzle (to the long side) serves as a peak. With the slope like this, not only the flow rate and flow modality of the molten steel can be further changed so as to be optimized.

In addition, the protrusion length of the central protrusion portion may be gradually decreased in such a way that the upper surface may be slanted toward the both edge parts of the immersion nozzle in the width direction (long side) in which the protrusion length is the largest in the center part of the immersion nozzle in the width direction, whereby the center part serving as a peak. With the slope like this, not only the flow rate and flow modality of the molten steel can be further changed but also they can be optimized.

Because the flat immersion nozzle has the form that the discharge port in the side wall section in the short side is open and that the port is long in a vertical direction, the discharging flow rate in the discharge port is prone to be slower in the upper side thereof; and thus, especially around the upper edge part thereof, the phenomenon of reverse flow to cause suction of the molten steel into the immersion nozzle is observed often. Accordingly, in the present invention, in addition to the central protrusion portion, one or plurality of the protrusion portion may be disposed above the central protrusion portion (upper protrusion portion). This upper protrusion portion may have a similar structure to the central protrusion portion mentioned before; and in addition, the upper protrusion portion may be disposed symmetrically in a pair in the position apart from the center vertical axis of the immersion nozzle with an arbitrary distance.

The upper protrusion portion suppresses the decrease in the flow rate especially in the upper part of the discharge port or the reverse flow around the upper edge part thereof, so that this complements the function to equalize the flow rate distribution in each position of the discharge port in the vertical direction. In this upper protrusion portion, too, similarly to the central protrusion portion located below it, the protrusion length, angle, width, and the like can be optimized without dividing the inner hole space in accordance with an individual immersion nozzle structure, operation conditions, and the like. The slope of the upper surface to the width direction as well as the downward direction, the slope thereof to the thickness direction of the immersion nozzle, and the like of the central protrusion portion which is located below can be applied to this upper protrusion portion as well. By slanting the upper protrusion portion in the way as mentioned above, similarly to the central protrusion portion, the flow rate and flow modality of the molten steel can be further changed so as to be optimized.

When these protrusion portions (central protrusion portion and upper protrusion portion) are disposed in the flat section in which fluctuation of the molten steel flow is large as mentioned before, the effects thereof can be obtained. The locations thereof in the height direction of the immersion nozzle are not necessarily the same as the location of the discharge port in the vertical direction; and thus, they may be disposed in the optimum locations in view of relative relationships with the operation condition, structure of the inner hole of the immersion nozzle, structure of the discharge port, and the like.

Figure 5:
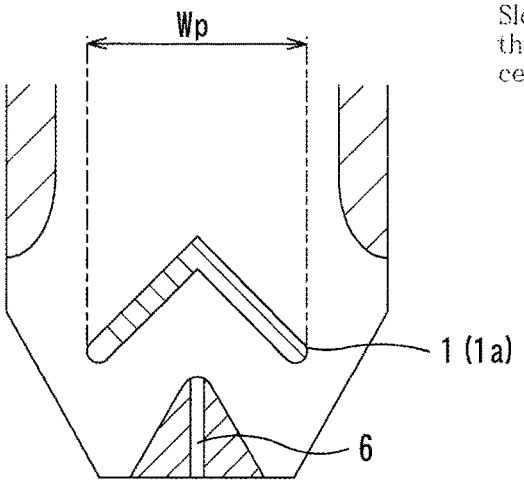
FIG. 5 is a conceptual figure illustrating, similarly to FIG. 4, another example of the cross section wherein Wp is further enlarged and a discharge port is disposed additionally in the bottom part.

Meanwhile, as depicted in FIGS. 1A and 1B, FIGS. 2A and 2B, and FIG. 4, the bottom part inside the immersion nozzle may be the wall having merely a flow-dividing function without forming a discharge port around the center part thereof; but the discharge port may be formed there as depicted in FIG. 5. Considering the mold as well as the structure of the immersion nozzle relative to individual operation condition, if total discharge amount (rate) to the mold is insufficient only with the discharge ports in the side wall, or the flow rate of molten steel in a traverse direction or an upward direction in the mold is intended to be relatively decreased, or the like, it is preferable to form the discharge port in the bottom part.

In the flat immersion nozzle, depending on the degree of flatness of the inner hole space (namely, depending on the ratio between the long side length and the short side length), flow modality of the molten steel, or flow rates of individual parts, or the modality and flow rate of the discharging flow can change. Therefore, the optimization thereof is carried out preferably by considering the relationship among the degree of flatness, the structure thereof, and individual operation conditions. Meanwhile, from experience, in the immersion nozzle having approximately 5 or more as Wn/Tn, the ratio of the width of the inner hole to the thickness of the same, the flow rate around the center part of the immersion nozzle is significantly different from the flow rate in the both edge parts of the same in the width direction; and thus, difference in the flow modality of the flow from the discharge port, fluctuation in the flow rate distribution, and the like are prone to be eminent. Accordingly, in the present invention, the immersion nozzle having Wn/Tn of approximately 5 or more is especially preferable.

EXAMPLES

Next, the present invention will be explained together with Examples.

Example 1

Example 1 shows experimental results of a water model with the first embodiment of the present invention illustrated in FIGS. 1A and 1B, namely, the immersion nozzle in which only the central protrusion portion is disposed as the protrusion portion (hereinafter, this is also referred to as simply "first embodiment"), wherein shown therein are: the fluctuation degree of the liquid surface in the mold vs. Wp/Wn, the ratio of the width Wp of the central protrusion portion to the width Wn of the inner hole of the immersion nozzle (length in the long side direction); and the fluctuation degree of the liquid surface in the mold vs. Tp/Tn, the ratio of the protrusion length Tp of the central protrusion portion in the space direction (total length of the pair) to the thickness Tn of the inner hole of the immersion nozzle (length in the short side direction).

Figure 9:
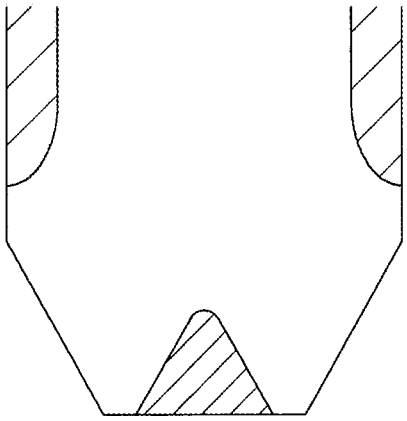
Fig 9 (Prior Art)
FIG. 9 is a conceptual figure illustrating an example of the immersion nozzle according to a conventional technology wherein the protrusion portion is absent (the rest is the same as FIGS. 1A and 1B).

Comparative Example relates to the structure depicted in FIG. 9, namely, relates to the immersion nozzle having the structure that the protrusion portion is removed from the immersion nozzle of the embodiment depicted in FIGS. 1A and 1B.

Specification of the immersion nozzle is as follows:

Total length: 1165 mm

Molten steel inlet: ϕ 86 mm

Width of the inner hole at the upper edge position of the discharge port (Wn): 255 mm Thickness of the inner hole at the upper edge position of the discharge port (Tn): 34 mm Height of the upper edge position of the discharge port from the nozzle's lower edge surface: 146.5 mm Height of the central protrusion portion (height from the nozzle's lower edge surface): 155 mm Length of the central protrusion portion (length of the right to left from the center): 80 mm Thickness of the immersion nozzle wall: about 25 mm Thickness of the immersion nozzle bottom part (peak): height of 100 mm The mold and conditions of the fluid are as follows:

Width of the mold: 1650 mm

Thickness of the mold: 65 mm (center in the upper edge part: 185 mm)

Immersion depth (from the upper edge of the discharge port to the water surface): 180 mm Supply rate of the fluid: 3.5 ton/minute Converted value to the molten steel The fluctuation degree of the liquid surface in the mold was obtained in the way as follows. Namely, the water surface was regarded as the liquid surface (molten steel surface) in the mold used in continuous casting, and the distance to the water surface was measured by an ultrasonic sensor from the above thereof, and then, the fluctuation height was calculated. The measurement was made at 4 positions as a total, namely, in the positions at 50 mm apart from the width edge parts in both sides in the left and right width directions and at the ¼ width positions wherein the immersion nozzle was regarded as the center; and the fluctuation degree was calculated from the difference between the maximum and minimum values in the fluctuation heights thus measured.

Meanwhile, in Example 2 and all the Examples thereafter, the specification of the immersion nozzle, the mold, and the conditions of the fluid are the same as those of Example 1.

The structure was employed wherein the slope angle of the central protrusion portion in all the direction is zero degree (not slanted), the protrusion thickness of the central protrusion portion in the width direction is constant (rectangular in the top view), and there is no slope in the inner hole center direction.

The results of the fluctuation degree of the liquid surface in the mold as expressed by the indicator are shown in Table 1, wherein the value in Comparative Example (structure depicted in FIG. 9) is regarded as 100 (hereinafter, this indicator is also referred to as simply "fluctuation indicator").

When this fluctuation indicator is used as the criterion, it has been demonstrated that when the fluctuation degree is more than about 40, quality deterioration is outside the acceptable degree in the actual operation of continuous casting. Accordingly, in the present invention, the fluctuation degree with which the problem of the present invention can be solved, namely, the target fluctuation degree was set in the range of 40 or less.

As a result, in the structure having the central protrusion portion, as compared with Comparative Example of FIG. 9, it was found that the target value of 40 or less can be obtained in Examples in which the Wp/Wn ratio is 0.2 or more and 0.7 or less and the Tp/Tn ratio is 0.15 or more and 0.75 or less. In addition, because the maximum effect can be obtained when the Tp/Tn ratio is 0.5 and the Wp/Wn ratio is 0.5, it can be seen that these ratios are preferable.

TABLE 1

| Wp (mm) | 0 | 51 | 127.5 | 178.5 | 204 |
|---|---|---|---|---|---|
| Wp/Wn | 0 | 0.2 | 0.5 | 0.7 | 0.8 |
| 0 Tn | 100 | — | — | — | — |
| 0.10 Tn | — | 70 | 62 | 68 | 83 |
| 0.15 Tn | — | 38 | 35 | 38 | 77 |
| 0.50 Tn | — | 35 | 30 | 35 | 61 |
| 0.75 Tn | — | 37 | 36 | 36 | 72 |
| 0.90 Tn | — | 47 | 42 | 45 | 92 |

Example 2

Example 2 shows experimental results of a water model which relates to the immersion nozzle of the first embodiment of the present invention as illustrated in FIGS. 1A and 1B, wherein shown therein is the fluctuation degree of the liquid surface in the mold by using the structure slanting from the center of the central protrusion portion to the discharge port side as well as the downward direction.

Experiments thereof were carried out by using the central protrusion portion structure in which the Wp/Wn ratios are 0.1, 0.5, and 0.8; the Tp/Tn ratios are 0.1, 0.5, and 0.9; and the slope angles of the central protrusion portion to the traverse direction (horizontal direction) of the immersion nozzle are 30 degrees and 45 degrees. Meanwhile, for comparison, experiments were also carried out with the same element conditions as the above conditions and without the slope (slope angle of zero degree).

These results are summarized in Table 2. As a result, it can be seen that in all the experiments, when the slope angle is increased, the fluctuation degree of the liquid surface in the mold is decreased. Meanwhile, among these conditions, it can be seen that when the Wp/Wn ratio is 0.5 and the Tp/Tn ratio is 0.5, the target value of 40 or less can be obtained in any slope angles.

TABLE 2

| | Wp/Wn | | | | | | | | |
|---|---|---|---|---|---|---|---|---|---|
| | 0.1 | | | 0.5 | | | 0.8 | | |
| | Angle (degree) | | | | | | | | |
| | 0 | 30 | 45 | 0 | 30 | 45 | 0 | 30 | 45 |
| 0.10 Tn | 95 | 87 | 77 | 62 | 47 | 41 | 83 | 54 | 49 |
| 0.50 Tn | 84 | 74 | 67 | 30 | 29 | 15 | 61 | 52 | 47 |
| 0.90 Tn | 73 | 63 | 57 | 65 | 50 | 47 | 92 | 56 | 51 |

Example 3

Figure 6:
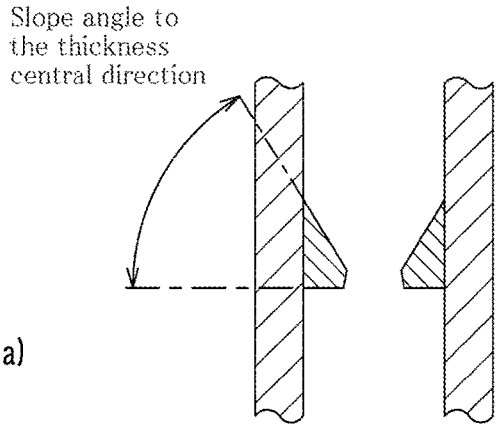
FIG. 6 is a cross section view of the center of the immersion nozzle in the width direction (A-A position in FIG. 3, etc.), which is a conceptual figure illustrating an example wherein the upper surface of the central protrusion portion slants to the inner hole center direction.

Example 3 shows experimental results of a water model which relates to the immersion nozzle of the first embodiment of the present invention as illustrated in FIGS. 1A and 1B, wherein shown therein is the effect of the slope in the central protrusion portion structure (see FIG. 6) that the upper surface of the central protrusion portion is slanted to the center direction of the thickness direction of the immersion nozzle as well as the downward direction, in which the boundary portion of the upper surface of the central protrusion portion with the wall surface of the immersion nozzle in the width direction (long side) serves as a peak.

Experiments thereof were carried out by using the central protrusion portion structure in which the Wp/Wn ratios are 0.1, 0.5, and 0.8; the Tp/Tn ratio is 0.5; the slope angle to the discharge port side is 45 degrees; and the slope angles to the thickness, center direction are 30 degrees and 45 degrees. Meanwhile, for comparison, experiments were also carried out with the same element conditions as the above conditions and without the slope (slope angle of zero degree).

These results are summarized in Table 3. As a result, it can be seen that in all the experiments, when the slope angle is increased, the fluctuation degree of the liquid surface in the mold is decreased. Meanwhile, it can be seen that when the Wp/Wn ratio is 0.5 and the Tp/Tn ratio is 0.5, the target value of 40 or less can be obtained in any slope angles.

TABLE 3

| | Wp/Wn | | | | | | | | |
|---|---|---|---|---|---|---|---|---|---|
| | 0.1 | | | 0.5 | | | 0.8 | | |
| | Angle (degree) | | | | | | | | |
| | 45 | | | 45 | | | 45 | | |
| | Tp/Tn | | | | | | | | |
| | 0.5 | | | 0.5 | | | 0.5 | | |
| | Slope angle to center direction | | | | | | | | |
| | 0 | 30 | 45 | 0 | 30 | 45 | 0 | 30 | 45 |
| Fluctuation indicator | 67 | 61 | 57 | 15 | 13 | 10 | 47 | 45 | 49 |

Example 4

Figure 7:
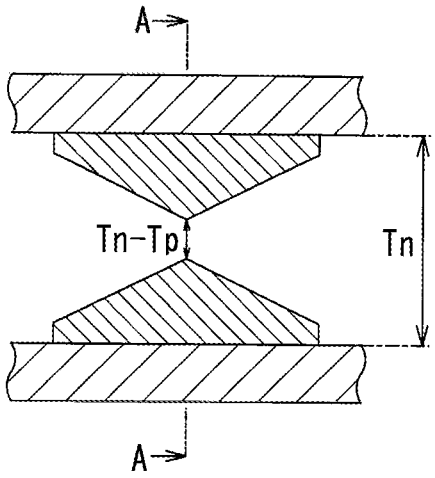
FIG. 7 is a top view of the cross section of the A-A position of FIG. 4, which is a conceptual figure illustrating an example wherein the protrusion length of the central protrusion portion to the inner hole center direction decreases gradually from the center to a width direction of the inner hole.

Example 4 shows experimental results of a water model which relates to the immersion nozzle of the first embodiment of the present invention as illustrated in FIGS. 1A and 1B, wherein shown therein is the fluctuation degree of the liquid surface in the mold by using the structure in which the protrusion length is gradually decreased from the center of the central protrusion portion to the width direction of the immersion nozzle (edge part) and that the top view of the central protrusion portion has an angle so as to form the pentagonal structure (see FIG. 7).

Experiments thereof were carried out by using the central protrusion portion structure in which the Wp/Wn ratios are 0.1, 0.5, and 0.8; the Tp/Tn ratio is 0.5; the slope angle to the discharge port side in the width direction is 45 degrees; the slope angle to the thickness, center direction is 0 degree (not slanted); and the length of the peak in the center part of the central protrusion portion is 8 mm. Meanwhile, for comparison, experiments were also carried out with the same element conditions as the above conditions and without the slope (rectangular in the upper face).

These results are summarized in Table 4. As a result, it can be seen that in any Wp/Wn ratio, when the length of edge part is 4 mm, the fluctuation degree of the liquid surface in the mold is small. Meanwhile, it can be seen that when the Wp/Wn ratio is 0.5, the Tp/Tn ratio is 0.5, and the slope angle of the central protrusion portion to the traverse (horizontal) direction of the immersion nozzle is 45 degrees, the target value of 40 or less can be obtained in any upper surface shape having an angle.

TABLE 4

| | Wp/Wn | | | | | | | | |
|---|---|---|---|---|---|---|---|---|---|
| | 0.1 | | | 0.5 | | | 0.8 | | |
| | Angle (degree) | | | | | | | | |
| | 45 | | | 45 | | | 45 | | |
| | Tp/Tn | | | | | | | | |
| | 0.5 | | | 0.5 | | | 0.5 | | |
| | Center part thickness | | | | | | | | |
| | 8 mm | | | 8 mm | | | 8 mm | | |
| | Edge part thickness | | | | | | | | |
| | 1 mm | 4 mm | 8 mm | 1 mm | 4 mm | 8 mm | 1 mm | 4 mm | 8 mm |
| Fluctuation indicator | 54 | 47 | 67 | 28 | 21 | 15 | 41 | 42 | 47 |

Example 5

Figure 8:
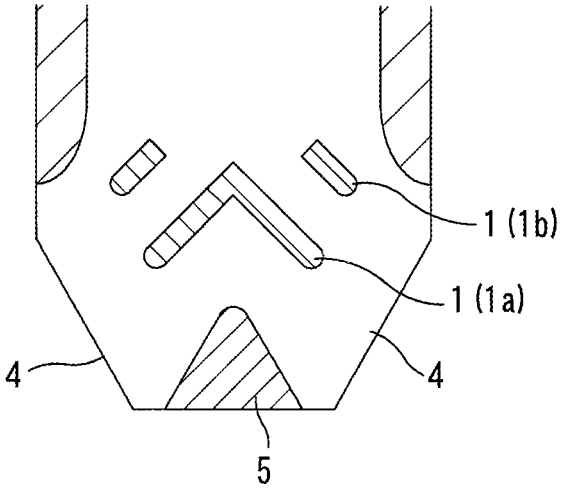
FIG. 8 is a conceptual figure illustrating the lower section of the immersion nozzle of the present invention (FIGS. 2A and 2B) which is provided with the upper protrusion portion in addition to the central protrusion portion.

Example 5 shows experimental results of a water model which relates to the second embodiment of the present invention as illustrated in FIG. 8, namely the embodiment wherein in addition to the lower central protrusion portion, above it the upper protrusion portion is disposed (hereinafter, this is also referred to as simply "second embodiment"). In this embodiment, the immersion nozzle has the structure in which the upper protrusion portion is disposed symmetrically in a pair in the position apart from the center axis of the immersion nozzle in the vertical direction with an arbitrary distance. The fluctuation degrees of the liquid surface in the mold using this structure are shown.

The experiments were carried out by using the lower central protrusion portion structure in which the peak thereof is located at the position where the center is 150 mm apart from the lower edge surface of the immersion nozzle (outside surface); the left and right lengths in the direction to the discharge port are 80 mm each; the Wp/Wn ratios are 0.1, 0.5, and 0.8; the Tp/Tn ratio is 0.5; the slope angle to the discharge port side in the width direction is 45 degrees; the slope angle to the thickness, center direction is zero degree (not slanted); and the upper surface view shape is rectangular (no angles). On the other hand, the upper protrusion portion has the structure in which the upper protrusion portion is disposed above the lower central protrusion portion and starts at the position 50 mm apart from the center of the immersion nozzle in the width direction to the left and right directions, respectively; the slope angle to the discharge port side is 45 degrees; and the lengths thereof to the direction of the discharge port are 60 mm and 40 mm. Meanwhile, for comparison, experiments were also carried out with the same element conditions as the above conditions and without disposing the upper protrusion portion.

These results are summarized in Table 5. As a result, it can be seen that in all the experiments, when the upper protrusion portion is disposed, the fluctuation degree of the liquid surface in the mold is decreased. Meanwhile, it can be seen that when the Wp/Wn ratio is 0.5 and the Tp/Tn ratio is 0.5, the target value of 40 or less can be obtained in any length of the upper protrusion portion.

TABLE 5

| | Wp/Wn | | | | | | | | |
|---|---|---|---|---|---|---|---|---|---|
| | 0.1 | | | 0.5 | | | 0.8 | | |
| | Angle (degree) | | | | | | | | |
| | 45 | | | 45 | | | 45 | | |
| | Tp/Tn | | | | | | | | |
| | 0.5 | | | 0.5 | | | 0.5 | | |
| | Upper protrusion portion | | | | | | | | |
| | — | 60 mm | 40 mm | — | 60 mm | 40 mm | — | 60 mm | 40 mm |
| Fluctuation indicator | 67 | 53 | 48 | 15 | 13 | 10 | 47 | 42 | 44 |

In the above, Examples of the present invention have been explained together with the embodiment thereof; however, the present invention is not limited at all to the embodiments described above. Therefore, other embodiments as well as modified examples thereof are included within the items described in the claims.

EXPLANATION OF THE NUMERAL SYMBOLS

10: Immersion Nozzle
1: Protrusion portion
1*a*: Central protrusion portion
1*b*: Upper protrusion portion
2: Molten steel inlet
3: Inner hole (flow path of molten steel)
4: Discharge port (wall portion in the short side)
5: Bottom part
6: Discharge port (bottom part)

The invention claimed is:

1. An immersion nozzle, wherein the immersion nozzle has a flat shape in which a width Wn of an inner hole is greater than a thickness Tn of the inner hole, the immersion nozzle comprising: a central protrusion portion including a first protruding portion in a center section of a first wall surface in a width direction of a flat section and a second protruding portion a center section of a second wall surface in the width direction of the flat section; Wp/Wn, which is a ratio of a length Wp of the central protrusion portion in the width direction to Wn, is 0.2 or more and 0.7 or less; the first and second protruding portions are disposed symmetrically as a pair; and a total length Tp of the pair of the first and second protruding portions in the thickness direction is 0.15 or more and 0.75 or less of Tn.

2. The immersion nozzle according to claim 1, wherein each of the first and second protruding portions slants downward to a discharge port direction from a center in the width direction, in which the said center serves as a peak.

3. The immersion nozzle according to claim 1, wherein an upper surface of each of the first and second protruding portions slants to the thickness direction as well as a downward direction, in which a boundary portion thereof with an immersion nozzle wall in the width direction serves as a peak.

4. The immersion nozzle according to claim 3, wherein a protrusion length of the upper surface is largest in a center part of Wp and gradually decreases in directions to both edge parts from the center part.

5. The immersion nozzle according to claim 1, wherein the immersion nozzle comprises an upper protrusion portion disposed above the central protrusion portion.

6. The immersion nozzle according to claim 5, wherein the upper protrusion portion slants to a discharge port direction.

7. The immersion nozzle according to claim 1, wherein Wn/Tn, is 5 or more.

8. The immersion nozzle according to claim 5, wherein the upper protrusion portion comprises a first member protruding from the first wall surface and spaced from the first protruding portion and a second member protruding from the second wall surface and spaced from the second protruding portion.

9. The immersion nozzle according to claim 8, wherein the first and second members are symmetrically disposed as a pair.

* * * * *